US005770986A

United States Patent [19]

Tonegawa et al.

[11] Patent Number: 5,770,986

[45] Date of Patent: Jun. 23, 1998

[54] STRIPLINE FILTER WITH A STRIPLINE-FORMED PARALLEL CAPACITOR

[75] Inventors: Ken Tonegawa, Kyoto; Harufumi Mandai, Takatsuki; Teruhisa Tsuru, Kameoka, all of Japan

[73] Assignee: Murata Manufacturing Co., Ltd., Nagaokakyo, Japan

[21] Appl. No.: 478,388

[22] Filed: Jun. 7, 1995

[30] Foreign Application Priority Data

Jun. 14, 1994 [JP] Japan ..... 6-132039

[51] Int. Cl.[6] ..... H01P 1/203

[52] U.S. Cl. ..... 333/204; 333/222

[58] Field of Search ..... 333/202, 203, 333/204, 205, 219, 222, 223, 235

[56] References Cited

U.S. PATENT DOCUMENTS

| | | | |
|---|---|---|---|
| 3,588,753 | 6/1971 | Shimizu | 333/21 R |
| 4,963,843 | 10/1990 | Peckham | 333/203 |
| 5,105,173 | 4/1992 | Itou | 333/203 X |
| 5,373,271 | 12/1994 | Hirai et al. | 333/204 X |
| 5,376,908 | 12/1994 | Kawaguchi et al. | 333/203 |
| 5,519,366 | 5/1996 | Kaneko et al. | 333/202 X |

FOREIGN PATENT DOCUMENTS

| | | | |
|---|---|---|---|
| 2 525 835 | 10/1983 | France . | |
| 40 29 664A1 | 3/1992 | Germany . | |
| 42 13 195A1 | 10/1993 | Germany . | |
| 4420060 | 12/1994 | Germany | 333/204 |
| 1319304 | 12/1989 | Japan | 333/219 |
| 3196701 | 8/1991 | Japan | 333/204 |
| 5308202 | 11/1993 | Japan | 333/204 |
| 484 531 | 1/1970 | Switzerland . | |

*Primary Examiner*—Benny T. Lee
*Assistant Examiner*—Justin P. Bettendorf
*Attorney, Agent, or Firm*—Burns, Doane, Swecker & Mathis, LLP

[57] ABSTRACT

A resonator having an improved spurious characteristic is provided. The resonator comprises a dielectric substrate having a plurality of strip lines extending longitudinally from the central portion of the upper surface toward the rear surface of the substrate by turning downward along the shorter side surfaces of the substrate such that the strip lines extending from both sides of the upper surface of the substrate are arranged in an alternative fashion with their narrowed top end portions overlapping each other in spaced apart relationships so as to be electromagnetically coupled. The portion of the dielectric substrate sandwiched between the opposing upper and rear portions of each strip line forms a capacitor. Further, a ground electrode is formed at the center of the rear surface of the substrate so as to be connected to the end portions of the strip lines. Input and an output electrode continuous with some of the strip lines, respectively, are also provided on the rear surface of the substrate.

17 Claims, 4 Drawing Sheets

STRIPLINE FILTER WITH A STRIPLINE-FORMED PARALLEL CAPACITOR

BACKGROUND OF THE INVENTION

1. Field of the Invention

The present invention relates to a distributed, constant type resonator which can be used with a high frequency circuit and which can be adapted to reduce higher harmonic components in a signal.

2. State of the Art

A conventional resonator represented as a distributed constant type bandpass filter is shown in FIGS. 6*a* and 6*b*, which are a plan view and a sectional view thereof, respectively. In FIGS. 6*a* and 6*b*, reference numeral 21 designates a dielectric substrate having ground electrodes 22 and 23 at both side ends of a surface thereof, respectively. A plurality of strip lines 24 and 26 extend from the electrode 22 toward the center of the substrate. The strip lines have their top ends which are located toward the center of the substrate narrowed in width. A plurality of strip lines 25 and 27 extend from the electrode 23 toward the center of the substrate, and also have their top ends which are located toward the center of the substrate narrowed in width. The strip lines 24 through 27 are arranged in an alternating fashion so that the narrowed top ends of the alternating strip lines are adjacent one another in spaced apart relationships at the central portion on the upper surface of the substrate. Further, input and output electrodes 28 and 29 are formed on opposite sides of the substrate, respectively. A ground electrode 30 is formed on substantially the entire rear (or lower) surface of the dielectric substrate 21, to thereby provide a bandpass filter 31.

The bandpass filter 31 of the above structure resonates at a frequency of f1 associated with a wavelength λ, where the length of each of the strip lines 24 through 27 is λg/4 with λg being expressed by the following equation:

$$\lambda g=\lambda/\sqrt{\in}$$

wherein ∈ designates the dielectric constant of the dielectric substrate.

However, the bandpass filter 31 has the disadvantage that, in addition to the resonant frequency f1 associated with the length λg/4 of each strip line, higher harmonic resonance also occurs at each of frequencies f3, f5 and so forth, which are odd multiples of f1 (for example $3f_1$, $5f_1$ and so forth), respectively. These higher harmonic frequencies are associated with lengths of the strip lines 24–27 represented as λg/12, λg/20 and so forth. Consequently, a spurious characteristic of the filter generates an undesired pass band which is difficult to remove from the filter.

SUMMARY OF THE INVENTION

The present invention is directed to eliminating the above-described problem. An exemplary object of the present invention is to provide a resonator circuit wherein capacitors are connected parallel to inductance components of distributed constant lines, and a parallel resonance frequency of the circuit is made to coincide with the higher harmonic resonance frequency, thereby improving the spurious characteristic of the filter.

In order to achieve the foregoing object, exemplary embodiments of the present invention are directed to use of a resonator comprising a dielectric substrate having distributed constant lines thereon. Further, capacitors are provided in the dielectric substrate which are connected parallel to inductance components of the distributed constant lines.

Another feature of the present invention resides in the provision of at least a first dielectric substrate, a second dielectric substrate and capacitors. In exemplary embodiments, the first substrate is provided with a plurality of strip lines extending longitudinally from a central portion of an upper surface of the substrate to a rear surface of the substrate, the strip lines being turned back along shorter length side surfaces of the substrate, such that top ends of the strip lines located on the upper surface are electromagnetically coupled. The second substrate is laminated on the upper surface of the first substrate and is provided with a plurality of ground electrodes. Capacitors connected parallel to the inductance components of the strip lines are formed at the turned-back portions of the strip lines.

A further feature of exemplary embodiments of the present invention resides in that a parallel resonance frequency based on the above-mentioned inductance components and the capacitors is made to coincide with a higher harmonic resonance frequency of the resonator.

According to the above-described exemplary structures, since the dielectric substrate is provided with capacitors parallel-connected with the distributed constant strip lines, a frequency response pole in the impedance at the parallel resonance frequency can be made to coincide with that of a higher harmonic resonance frequency of the resonator. As a result, an undesired pass band due to resonance at a frequency which is an odd multiple of f1 is controlled, thereby improving the spurious characteristic of the resonator.

PREFERRED EMBODIMENTS OF THE INVENTION

Preferred embodiments of the present invention will be described with reference to the accompanying drawings.

Figure 1:
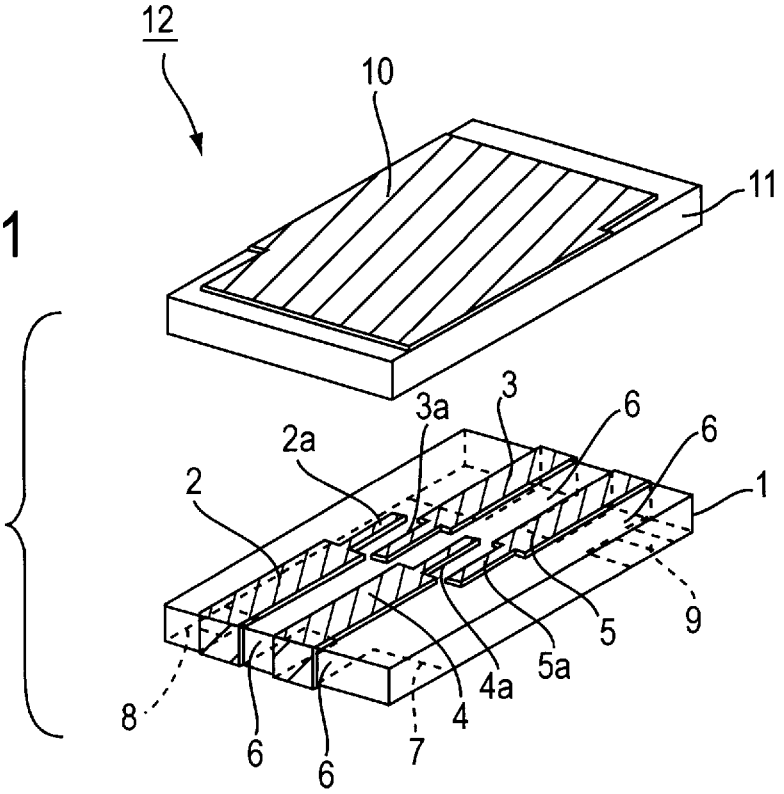
FIG. 1 is an exploded perspective view of a bandpass filter according to an exemplary embodiment of the present invention.
Figure 2:
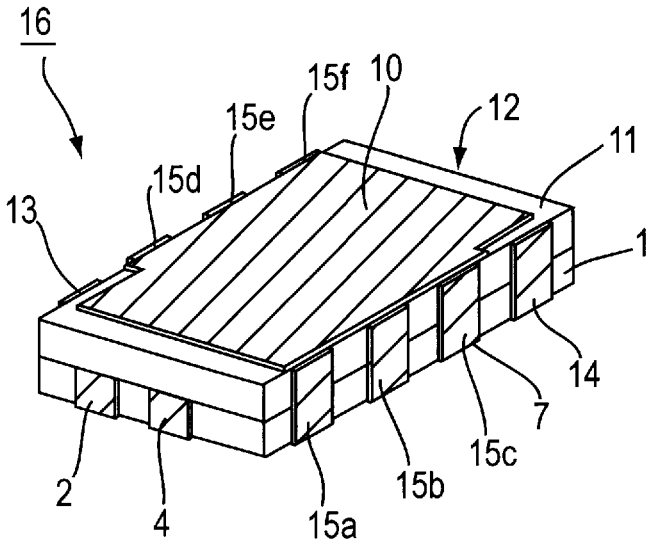
FIG. 2 is a perspective view of a bandpass filter according to the exemplary embodiment shown in FIG. 1.

FIG. 1 is an exploded perspective view of a bandpass filter formed as a resonator according to an exemplary embodiment of the present invention. FIG. 2 is a perspective view of a complete resonator product.

In FIG. 1, a dielectric substrate 1 is provided with a plurality of conductive strip lines 2, 3, 4 and 5 extending longitudinally from a central portion of a first upper surface to a second rear (or lower) surface of the substrate made of dielectric ceramics, each strip line being turned back along one or the other of a first set of opposing sides of the substrate (for example, shorter side surfaces of the substrate), respectively, in an alternating fashion. Top, open ends 2*a*–5*a* of the strip lines 2–5 formed on the upper surface of the substrate 1 can be formed narrower in width than the remaining portions, so as to lie parallel one another at the central portion of the substrate and thereby establish mutual electromagnetic couplings among them. Further, a portion of the substrate sandwiched between opposing portions of each strip line (that is, a portion of the substrate located between: (1) a first portion of a strip line on the upper surface of the substrate, and (2) a second portion of the same strip line turned back to the lower surface of the substrate) forms a capacitor 6 with the dielectric substrate serving an intermediate layer.

At a central portion of the rear surface of the dielectric substrate 1, there is formed a ground electrode 7 which is connected to the ends of the strip lines 2–5 at the rear surface of the dielectric substrate 1. Further, there are formed an input electrode 8 and an output electrode 9 which extend from the strip lines 2 and 5 at the rear surface of the dielectric substrate 1 to second opposing sides (for example, the longer side ends) of the dielectric substrate 1, respectively. Moreover, another dielectric substrate 11 made of dielectric ceramics is fixed (for example, laminated) or co-fired with the dielectric substrate 1 on the upper surface of the dielectric substrate 1. A ground electrode 10 is formed on the upper surface of the dielectric substrate 11 located on a side of the dielectric substrate 11 which is opposite the first dielectric substrate 1, to thereby provide a combined, laminated or monolithic component 12.

Further, as shown in FIG. 2, on a side surface of the lamination 12, there are formed external electrodes 13 and 14 connected to the input electrode 8 and the output electrode 9, respectively. Grounding electrodes 15*a*–15*f* are connected to the ground electrodes 7 and 10, thereby constituting a bandpass filter 16.

In the bandpass filter 16 of the above-described structure, the capacitors 6 are connected in parallel with the inductance components of the strip lines 2–5. Further, a frequency response pole occurs in the impedance at the parallel resonance frequency due to the inductance components of the strip lines 2–5 and the capacitors 6. Thus, if this frequency response pole is made to coincide with the higher harmonic resonance frequency of the bandpass filter 16, a pass band due to a higher harmonic resonance can be controlled to thereby improve the spurious characteristic of the resonator. The static capacitance of the capacitor 6 can, of course, be adjusted by changing the dielectric constant and/or the thickness of the dielectric substrate, and/or by changing the area of the opposing portions for each of the turned-back strip lines 2–5.

Figure 3:
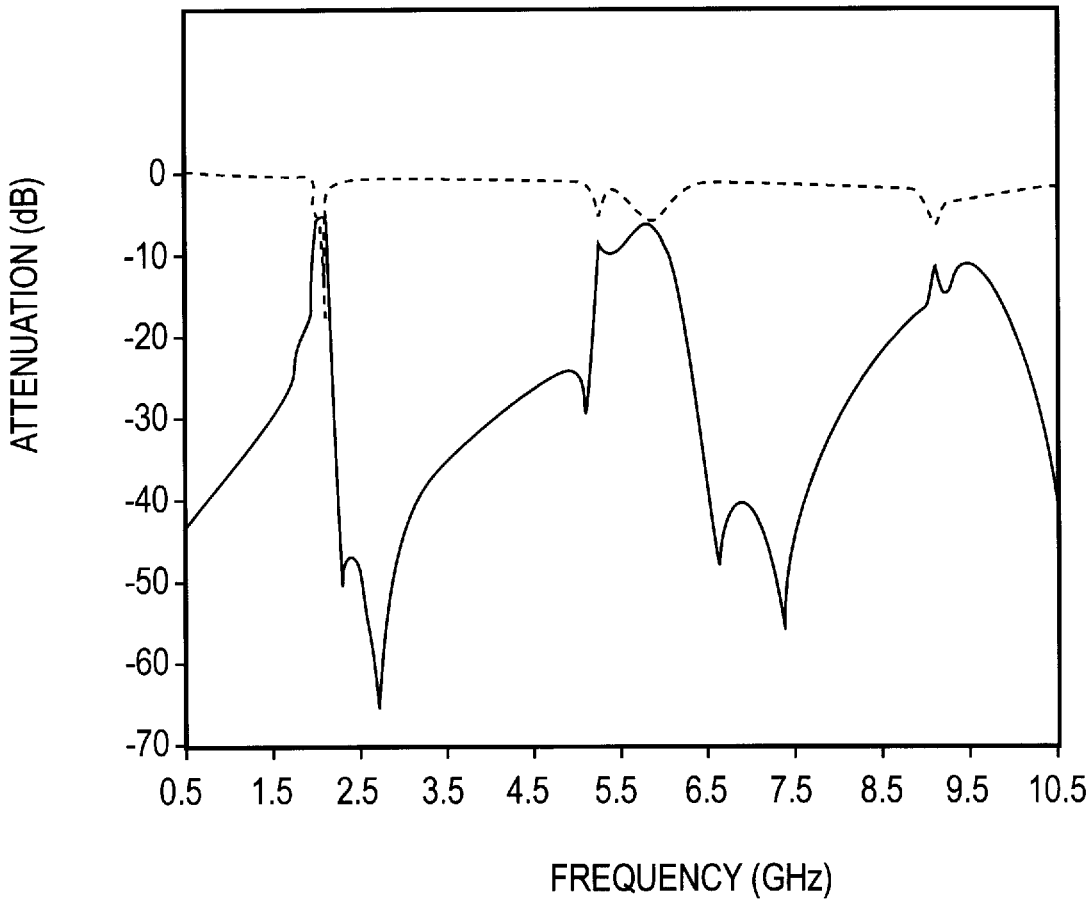
FIG. 3 is a graph showing a filtering characteristic of a conventional bandpass filter.
Figure 4:
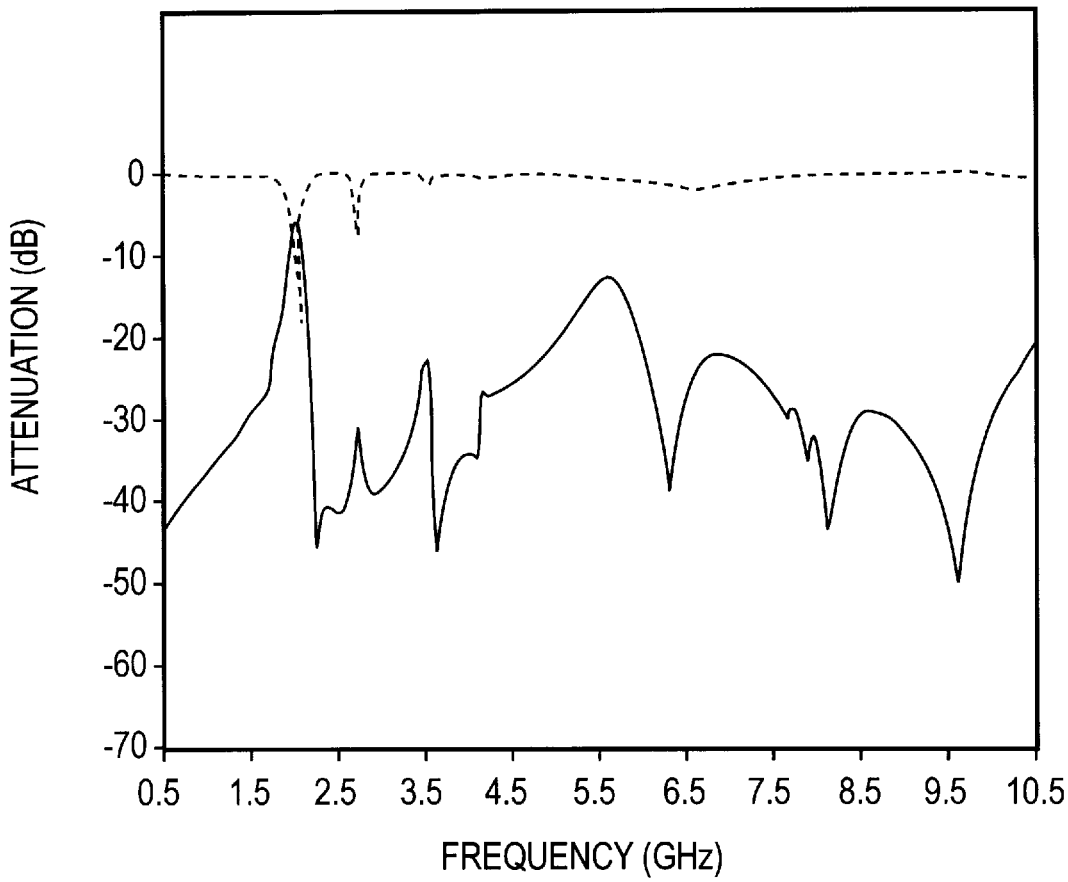
FIG. 4 is a graph showing a filtering characteristic of the exemplary bandpass filter shown in FIG. 2.

To further illustrate features of the present invention, the filtering characteristic of the conventional bandpass filter is shown in FIG. 3 while a filtering characteristic of a bandpass filter according to an exemplary embodiment of the present invention is shown in FIG. 4. The exemplary FIG. 4 characteristic represents a setting of the parallel resonance frequency due to the inductance components of the strip lines and the capacitors to a higher harmonic resonance frequency of, for example, about 6 GHz. In FIGS. 3 and 4, the solid lines designate the bandpass characteristics and the broken lines designate reflection or return loss characteristics. As will be clear from FIGS. 3 and 4, a bandpass filter according to the exemplary embodiment of the present invention has its higher harmonic resonance controlled to improve its spurious characteristic.

Figure 5:
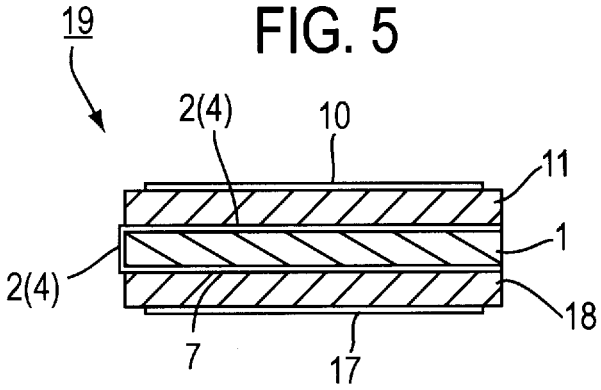
FIG. 5 is a sectional view of a bandpass filter according to a second exemplary embodiment of the present invention.
Figure 6A:
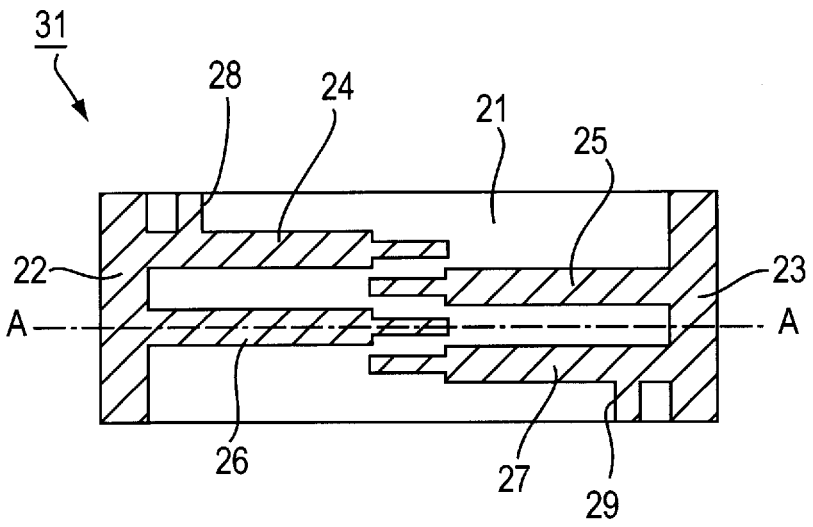
FIG. 6(a) PRIOR ART
FIG. 6*a* is a plan view of a conventional bandpass filter.
Figure 6B:
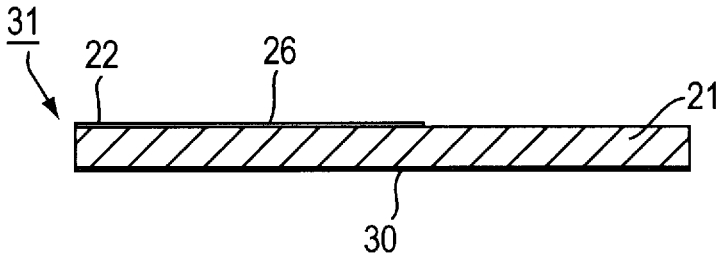
FIG. 6(b) PRIOR ART
FIG. 6*b* is a sectional view taken along the A—A line of FIG. 6*a*.

Although the bandpass filter 16 shown in FIG. 2 is of a double layer (or stacked) structure comprising the dielectric substrates 1 and 11, a bandpass filter 19 of a three-layer (-stacked) monolithic structure can also be implemented, as illustrated in FIG. 5, wherein, as mentioned previously, elements as described with respect to FIG. 2 have been afforded the same reference numerals. The FIG. 5 embodiment is formed by laminating a dielectric substrate 18 made of dielectric ceramics on the rear (lower) surface of the dielectric substrate 1. The dielectric substrate 18 has a ground electrode 17 formed on the rear surface of the dielectric substrate 18 as shown in FIG. 5. The exemplary FIG. 5 embodiment has the same operation and effect as the bandpass filter 16 of FIG. 2. The dielectric substrate 18 is similar to the dielectric substrate 11 in structure.

As described above, exemplary embodiments of a resonator in accordance with the present invention, include at lease one distributed constant strip line and at least one capacitor connected parallel thereto on the dielectric substrate. A parallel resonance frequency due to the inductance component of the distributed constant strip line and the capacitor can be made to coincide with the higher harmonic resonance frequency of the resonator so that an undesired pass band due to at least one higher harmonic resonance is controlled, to thereby improve the spurious characteristic of the resonator.

Those skilled in the art will appreciate that dimensions of the constant strip lines having reduced width portions on the upper surface of the dielectric 1 can be selected in any known fashion to achieve desired pass band characteristics. For example, these dimensions can be selected in accordance with the same techniques used to select dimensions for the constant strip lines of FIG. 1. Further, exemplary dimensions of the dielectric can be selected to achieve characteristics for the bandpass filter in a manner similar to that used to select a dielectric with respect to a conventional resonator, with the exception that in accordance with exemplary embodiments of the present invention, the thickness of the dielectric can be selected with characteristics of the capacitors 6 kept in mind.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A resonator comprising:

a first dielectric substrate having at least one distributed constant strip line formed thereon; and at least one capacitor connected parallel to at least one inductance component of the at least one distributed constant strip line, said at least one capacitor being formed with a first portion of said at least one distributed constant strip line located on a first surface of the first dielectric substrate, a second portion of said at least one distributed constant strip line located opposite said first portion on a second surface of said dielectric substrate, and a portion of said dielectric substrate located between said first and second portions of said at least one distributed constant strip line;

wherein a parallel resonance frequency due to said inductance component and said capacitor coincides with a harmonic resonance frequency of said resonator.

2. A resonator according to claim 1, further including:

an input electrode and an output electrode formed on said first dielectric substrate; and a plurality of distributed constant strip lines formed on a first surface of said first dielectric substrate, each of said plurality of distributed constant strip lines being formed in parallel on said first surface and being alternately connected to said input electrode and said output electrode on said second surface of said dielectric substrate, said second surface being opposite said first surface.

3. A resonator according to claim 2, wherein said first dielectric substrate further includes:

opposing sides which extend from said first surface to said second surface, each of said plurality of distributed constant strip lines extending from said first surface to said second surface of said dielectric substrate along one of said sides of said dielectric substrate.

4. A resonator according to claim 3, further including:

a plurality of capacitors, each capacitor being connected in parallel to said plurality of distributed constant strip lines and being formed with a first portion of one of said distributed constant strip lines located on said first surface of said dielectric substrate, a second portion of said one of said distributed constant strip lines located opposite said first portion on said second surface of said dielectric substrate, and a portion of said dielectric substrate located between said first and second portions of said one of said distributed constant strip lines.

5. A resonator according to claim 2 wherein each of said plurality of constant strip lines further includes:

a reduced width portion located on said first surface of said dielectric substrate, said constant strip lines being formed on said first surface in parallel with one another to establish mutual inductances.

6. A resonator according to claim 2, further including:

a second dielectric substrate having a ground plane formed thereon, said second dielectric substrate being laminated to said first dielectric substrate.

7. A resonator according to claim 6, further including:

external electrodes formed on sides of said laminated first and second dielectric substrates, each of said external electrodes being connected to one of said input electrode and said output electrode.

8. A resonator according to claim 7, further including:

a plurality of grounding electrodes located on said sides of said laminated first and second dielectric substrates, each of said grounding electrodes being electrically connected with said ground plane on said second dielectric substrate.

9. A resonator according to claim 6, further including:

a third dielectric substrate laminated to said second surface of said first dielectric substrate, said third dielectric substrate having a ground electrode formed on a surface thereof which is opposite a surface of said third dielectric substrate which faces said first dielectric substrate.

10. Apparatus for filtering a signal comprising:

a first dielectric substrate having first and second opposing surfaces;

an input electrode and an output electrode formed on said first dielectric substrate; and a plurality of parallel conductive strip lines alternately connected to said input electrode and said output electrode, each of said plurality of conductive strips having a first open end formed on said first surface of said first dielectric substrate and extending to a second end formed on said second surface of said first dielectric substrate, such that each of said plurality of conductive strips establishes an inductance and establishes a capacitor between said first open end and said second end, in parallel with said inductance, said capacitor being formed with a first portion of a conductive strip line located on said first surface of said dielectric substrate, a second portion of said conductive strip line located on said second surface of said dielectric substrate opposite said first portion, and a portion of said dielectric substrate located between said first and second portions of said conductive strip line;

wherein a parallel resonance frequency due to said inductance and said capacitor coincides with a harmonic resonance frequency of said apparatus.

11. Apparatus according to claim 10, wherein said first dielectric substrate further includes:

opposing sides which extend from said first surface to said second surface of said first dielectric substrate, each of said plurality of parallel conductive strip lines extending from said first surface to said second surface of said dielectric substrate along one of said sides of said dielectric substrate.

12. Apparatus according to claim 11, wherein each of said plurality of conductive strip lines further includes:

a reduced width portion located on said first surface of said dielectric substrate, each of said conductive strip lines being formed on said first surface in parallel to establish mutual inductances.

13. Apparatus according to claim 10, further including:

a second dielectric substrate having a ground plane formed thereon, said second dielectric substrate being laminated to said first dielectric substrate.

14. Apparatus according to claim 13, further including:

external electrodes formed on sides of said laminated first and second dielectric substrates, each of said external electrodes being connected to one of said input electrode and said output electrode.

15. Apparatus according to claim 14, further including:

a plurality of grounding electrodes located on said sides of said laminated first and second dielectric substrates, each of said grounding electrodes being electrically connected with said ground plane on said second dielectric substrate.

16. Apparatus according to claim 15, further including:

a third dielectric substrate laminated to said second surface of said first dielectric substrate, said third dielectric substrate having a ground electrode formed on a surface thereof which is opposite a surface of said third dielectric substrate which faces said first dielectric substrate.

17. A method for producing a resonator comprising the steps of:

forming a first dielectric substrate having first and second opposing surfaces;

forming an input electrode and an output electrode on said first dielectric substrate; and forming a plurality of parallel conductive strips alternately connected to said input electrode and said output electrode, each of said plurality of conductive strips having a first open end formed on said first surface of said first dielectric substrate and extending to a second end formed on said second surface of said first dielectric substrate, such that each of said plurality of conductive strips establishes an inductance and establishes a capacitor between said first open end and said second end, said inductance and said capacitor establishing a parallel resonance frequency which coincides with a harmonic resonance frequency of said resonator, said capacitor being formed with a first portion of a conductive strip line located on said first surface of said dielectric substrate, a second portion of said conductive strip line located on said second surface of said dielectric substrate opposite said first portion, and a portion of said dielectric substrate located between said first and second portions of said conductive strip line.

* * * * *